US006510621B2

(12) United States Patent
Camara et al.

(10) Patent No.: US 6,510,621 B2
(45) Date of Patent: Jan. 28, 2003

(54) DECK BOARD SPACING STRAP

(75) Inventors: David L. Camara, Norwell, MA (US); Christopher J. Higgins, Quincy, MA (US)

(73) Assignee: C. J. Higgins Engineering Co., Norwell, MA (US)

( * ) Notice: Subject to any disclaimer, the term of this patent is extended or adjusted under 35 U.S.C. 154(b) by 24 days.

(21) Appl. No.: 09/752,582

(22) Filed: Jan. 3, 2001

(65) Prior Publication Data

US 2002/0083610 A1 Jul. 4, 2002

(51) Int. Cl.[7] ..... G01D 21/00

(52) U.S. Cl. ..... 33/645; 33/526; 33/613; 33/770

(58) Field of Search ..... 33/613, 645, 526, 33/527, 518, 562, 770

(56) References Cited

U.S. PATENT DOCUMENTS

| | | | | |
|---|---|---|---|---|
| 1,549,671 A | | 8/1925 | Kridler et al. | |
| 2,187,087 A | | 1/1940 | Leary | |
| 2,377,020 A | * | 6/1945 | Lundeberg | 33/501.45 |
| 3,390,494 A | | 7/1968 | Chappie | |
| 4,121,604 A | * | 10/1978 | Rain | 52/4 R |
| 4,367,590 A | | 1/1983 | Winter et al. | |
| 4,742,654 A | | 5/1988 | Cole | |
| 4,749,302 A | | 6/1988 | DeClute | |
| 4,807,369 A | * | 2/1989 | Ming-Chin | 33/175 |
| 4,858,399 A | | 8/1989 | Salato, Jr. | |
| 4,955,142 A | * | 9/1990 | Rieck | 33/526 |
| 5,190,266 A | | 3/1993 | Barrera | |
| 5,609,122 A | * | 3/1997 | Jimmie | 116/173 |
| 5,687,539 A | * | 11/1997 | Bond | 52/748.1 |
| 5,832,619 A | * | 11/1998 | Volkema, Jr. | 33/527 |
| 6,360,448 B1 | * | 3/2002 | Smyj | 33/562 |

FOREIGN PATENT DOCUMENTS

| | | | | |
|---|---|---|---|---|
| JP | 57146105 A | * | 9/1982 | 33/732 |

* cited by examiner

*Primary Examiner*—Diego Gutierrez
*Assistant Examiner*—Travis Reis
(74) *Attorney, Agent, or Firm*—John P. McGonagle

(57) ABSTRACT

A deck board spacing strap. The strap has a series of spacer bars attached thereto thereby enabling a deck builder to position, space and hold a substantial number of deck boards in place at one time before nailing.

10 Claims, 4 Drawing Sheets

DECK BOARD SPACING STRAP

BACKGROUND OF THE INVENTION

This invention relates to decking tools, and in particular, to a spacing strap assembly which permits a user to align, space and hold decking boards in position prior to nailing.

Outdoor decks and patios have become increasingly popular in recent years and kits and do-it-yourself books are available to allow the homeowner as well as the construction professional to construct elaborate wooden decks and patios. The aesthetic appearance of the deck is usually judged by the appearance of the deck boards and their spacing and appearance. The deck boards are the final item normally installed after the deck joists have been positioned and leveled.

Deck boards are typically spaced apart to leave a gap between adjacent boards so that water can more readily drain from the deck surfaces. Spacing the boards equally along support beams and joists, however, has heretofore proven to be a relatively time consuming and laborious task. Deck boards are typically positioned, spaced and nailed, one-at-a-time. Unless the builder is very skilled, it is not unusual for the deck boards to become gradually out of line, thereby affecting the overall esthetics of the deck, but also in some cases the very structure of the deck.

SUMMARY OF THE INVENTION

The present invention provides a deck board spacing strap. The strap has a series of spacer bars attached thereto thereby enabling the deck builder to position, space and hold a substantial number of deck boards in place at one time before nailing. This enables the builder to review the deck board configuration before nailing. The present invention also permits the builder to position out-of-line boards in the least disruptive manner. With the deck boards assembled, positioned and properly spaced, nailing time and labor are substantially reduced.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
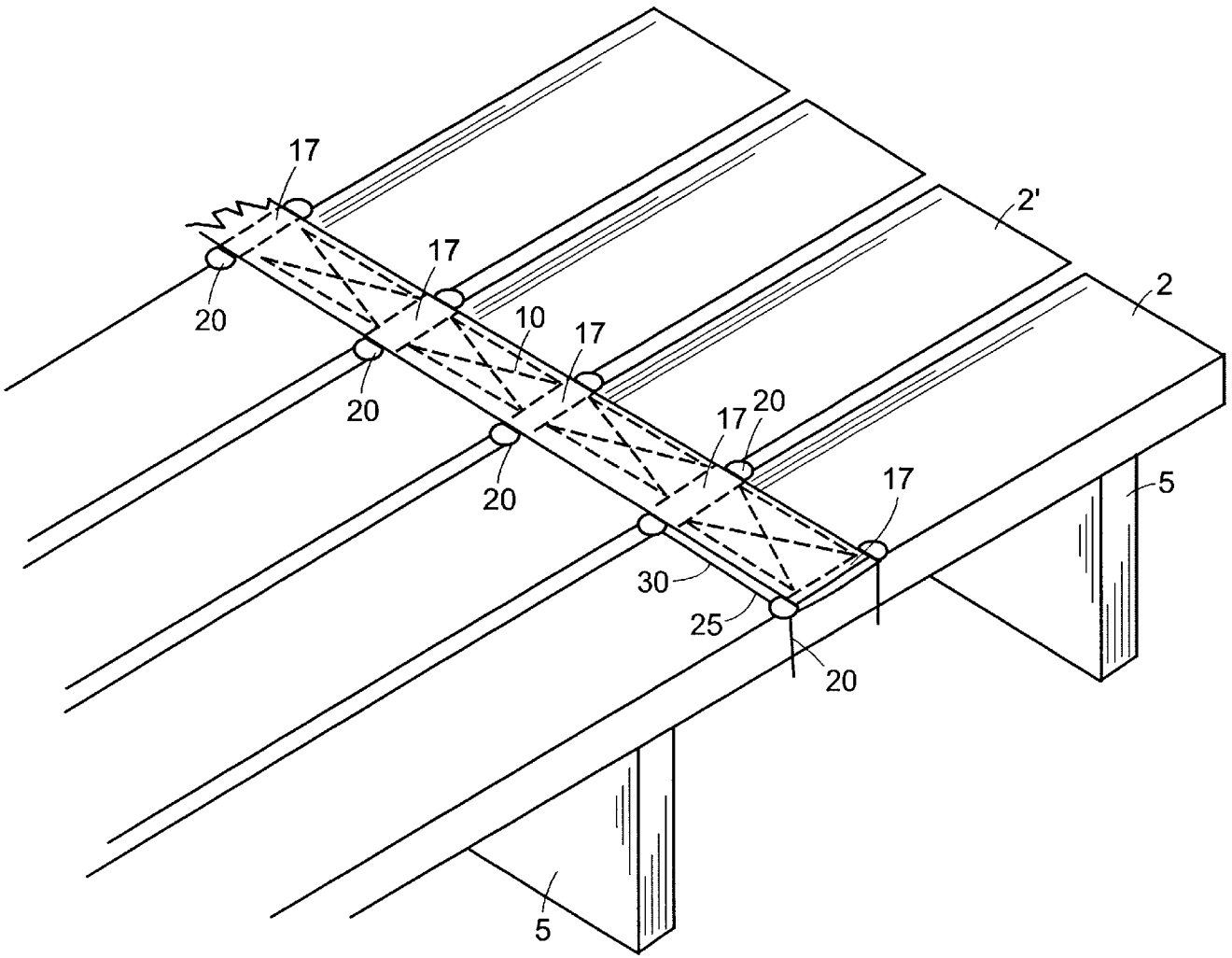
FIG. 1 is a top perspective of view the invention.
Figure 2:
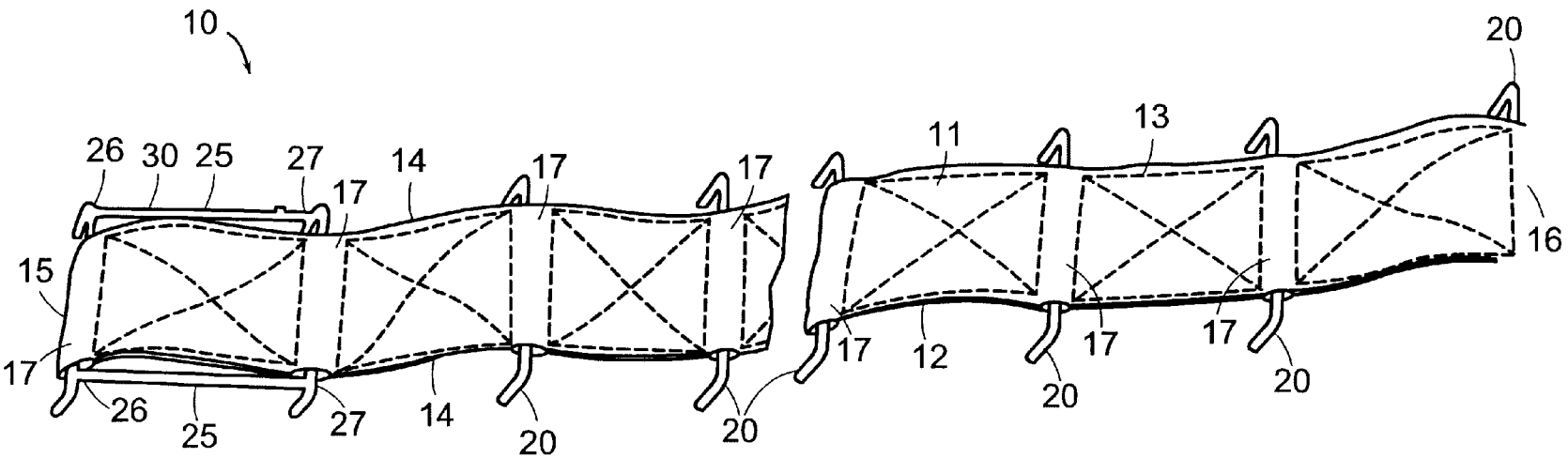
FIG. 2 is a close-up, perspective view, partly in section of the invention.

Referring to the drawings in detail wherein like elements are indicated by like numerals, there is shown an elongated, generally rectangular spacing strap 10 constructed according to the principles of the present invention. The spacing strap 10 is constructed with two elongated layers, a top layer 11 and a bottom layer 12. The layers are mirror images of each other. Each layer 11, 12 is preferably made from a nylon webbing material. Other materials providing comparable strength, toughness, durability and longevity may also be used. The top layer 11 is attached to the bottom layer 12 by stitching 13. Other means of attachment may also be used. The spacing strap 10 has two opposing, parallel, elongated sides 14 defining the strap width. Applicants have found an approximate width of two to three inches to be preferable. The spacing strap 10 has two ends, a proximal end 15 and a distal end 16, said ends defining the general longitudinal axis of the strap. Beginning at the proximal end 15 the strap layers form periodic, equidistant, generally cylindrical interstices 17 between each layer, each interstice having an elongated central axis transverse to the longitudinal axis of the spacing strap 10. Each interstice 17 opens out through both sides 14. In one embodiment of the invention, specifically adapted to be used with deck boards having an outside diameter width of five and five-eighths inches, the interstices 17 are longitudinally positioned six inches apart on center. In another embodiment of the invention, specifically adapted to be used with porch boards having an outside diameter width of three and five-eighths inches, the interstices 17 are longitudinally positioned four inches apart.

Figure 3:
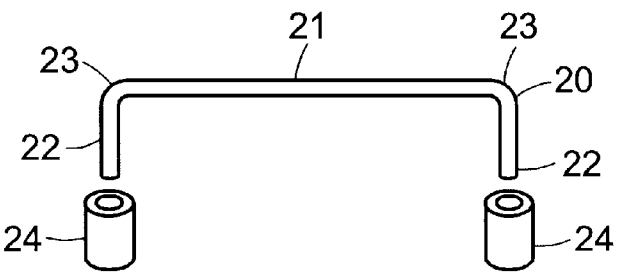
FIG. 3 is a close-up view of an individual spacer bar.

A U-shaped spacer bar 20 is inserted into each interstice 17. Each spacer bar 20 has an elongated, straight, intermediate, cylindrical portion 21 interconnecting two opposing, parallel, L-shaped, cylindrical spacer sections 22. Each spacer section 22 has a nominal diameter of three-sixteenths inches. Each spacer bar 20 is joined to the spacing strap 10 so that each spacer bar intermediate portion 21 is held within an interstice 17. The spacer bars 20 are preferably made from stainless steel. However, the spacer bars 20 may be made from any other sturdy, weather resistant material. Spacing cylinders 24 may be slid over the spacer sections 22 (See, FIG. 3) to adjust the radial thickness of each spacer section 22.

The first two spacer bars 20, beginning with the proximal strap end 15, are interconnected by two parallel, position bars 25, resulting in a double spacer bar assembly 30. Each position bar 25 interconnects the first spacer bar 20 with the second spacer bar 20. Each position bar 25 has two ends, a proximal end 26 and a distal end 27. Each position bar proximal end 26 is attached to the junction 23 of the first spacer bar intermediate portion 21 and a spacer section 22. The position bar distal ends 27 are attached to the junctions 23 of the second spacer bar intermediate portion 21 and spacer sections 22.

Figure 4:
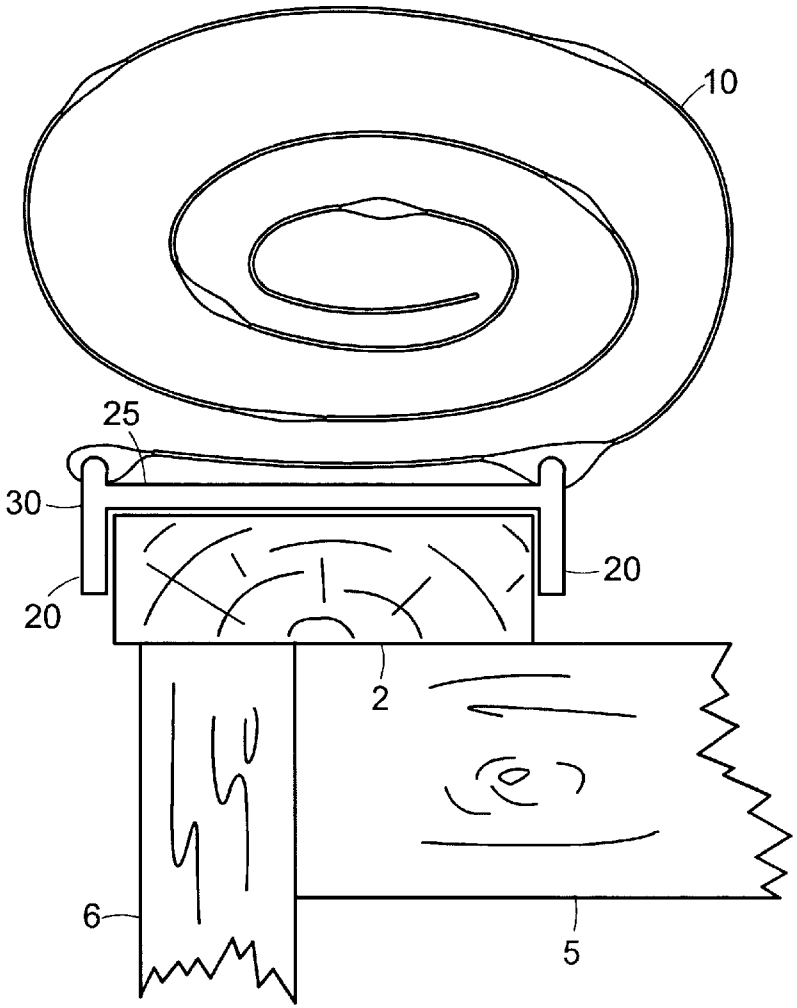
FIG. 4 is a side view of a double spacer bar assembly positioned over a first board.
Figure 5:
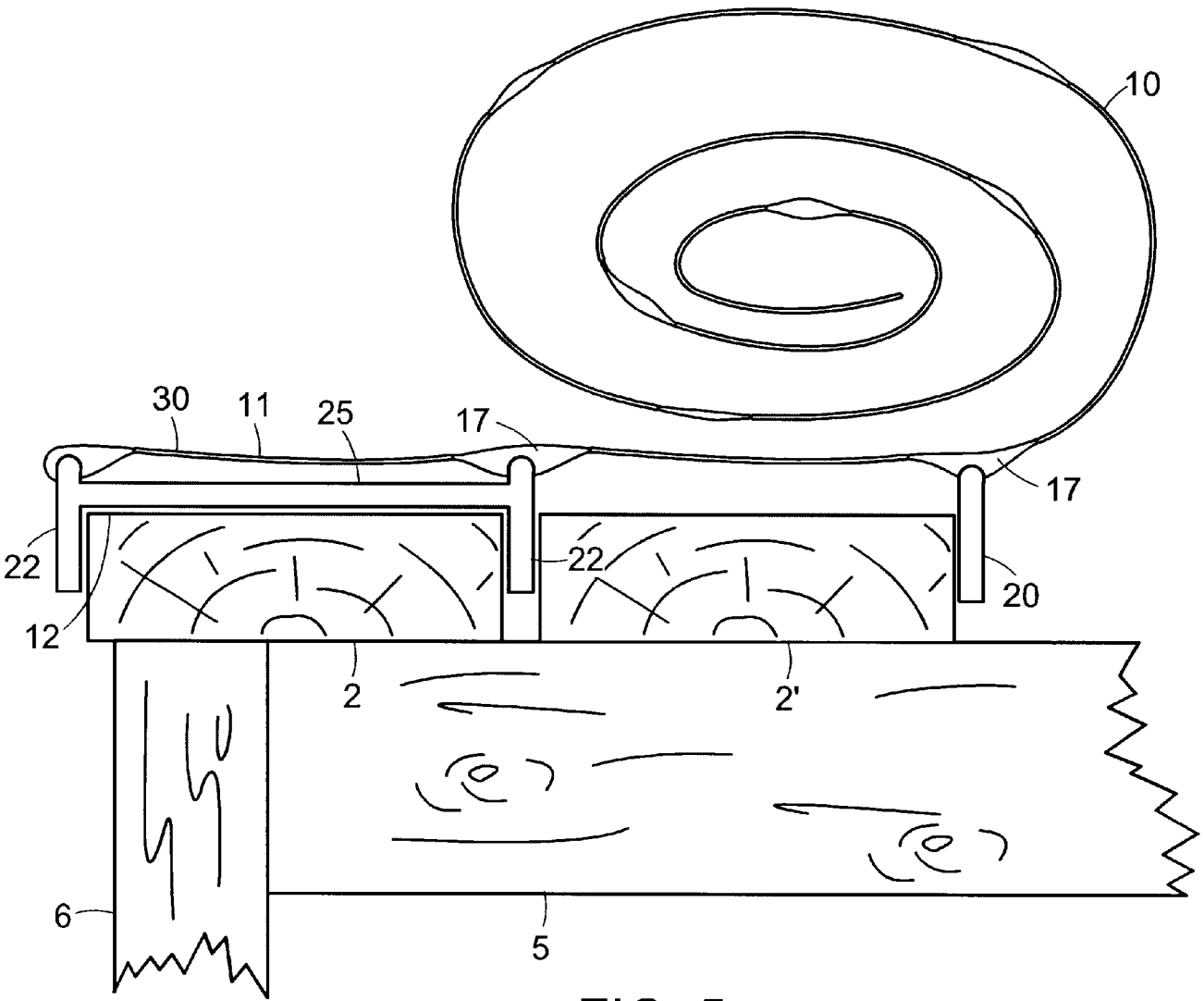
FIG. 5 is a side view of the first three spacer bars in place.

In operation, a first deck or porch board 2 is positioned and aligned as desired. The first board 2 is then attached to appropriate joists 5 and/or support beams 6. The builder then fixes the double spacer bar assembly 30 over the first board 2 keeping the remainder of the spacing strap 10 rolled up and positioned over the first board 2 and double spacer bar assembly 30 as shown in FIG. 4. Each spacer bar 20 is positioned about a board 2 so that the spacer bar intermediate portion 21 lies on the top 3 of a particular board 2 and the bar spacer sections 22 lie along the sides 4 of the board 2. The builder then assembles a desired number of additional boards 21 unrolling the spacing strap 10 across the boards 2' and inserting and positioning the strap spacer bars 20 between the boards 2, 2', etc. When all the boards are laid down with deck board spacer bars 20 properly in place, the spacing strap 10 will hold all in position until the builder follows with a screw gun, hammer, nail gun, or the like, securing all boards to the appropriate joists 5 and/or support beams 6. Typically two straps 10 would be used, however, any number of straps 10 may be used as desired. Separation between boards 2 may be adjusted by means of spacing cylinders 24 slid over the spacer bar spacer sections 22.

It is understood that the above-described embodiment is merely illustrative of the application. Other embodiments may be readily devised by those skilled in the art which will embody the principles of the invention and fall within the spirit and scope thereof. Space bars 20 may be made in different sizes and thicknesses. Spacing cylinders 24 may also be provided in different sizes and thicknesses.

We claim:

1. A spacing strap assembly adapted for alignment, spacing and holding decking boards prior to nailing, each said decking board having a top surface, a bottom surface, two sides interconnecting said surfaces, and two ends, said ends defining a board longitudinal axis, said strap assembly comprising an elongated, generally rectangular spacing strap adapted to being positioned on the top surfaces of said decking board transversely to each said board longitudinal axis; a plurality of U-shaped spacer bars attached to said strap and positioned equidistantly along said strap; the spacing strap having two opposing parallel, elongated sides defining a strap width, and two ends, a proximal end and a distal end, said ends defining the general longitudinal axis of the strip, wherein:

each spacer bar has an elongated, straight, intermediate, cylindrical portion interconnecting two opposing, parallel, L-shaped, cylindrical spacer sections.

2. A spacing strap assembly as recited in claim 1, wherein:

the spacing strap is comprised of two elongated layers, a top layer and a bottom layer, said layers being mirror images of each other end fixedly attached to each other.

3. A spacing strap assembly as recited in claim 2, wherein said spacing strap is further comprised of:

a plurality of equidistant, generally cylindrical interstices between said top and bottom layers, each said interstice having ail elongated central axis transverse to the longitudinal axis of the spacing strap, each said interstice opening out through both strap sides.

4. A spacing strap assembly as recited in claim 3, wherein:

the U-shaped spacer bar is positioned within each interstice, wherein each spacer bar intermediate portion is held within the interstice.

5. A spacing strap assembly as recited in claim 4, wherein:

the first spacer bar is positioned at the proximal strap end and the second spacer bar is positioned a specified distance from said first spacer bar toward the distal strap end, said first and second spacer bars being interconnected by the two parallel, elongated position bars, each said position bar being parallel to the spacing strap sides, each said position bar interconnecting the first spacer-bar with the second spacer bar.

6. A spacing strap assembly as recited in claim 5, wherein:

each position bar has two ends, a proximal end and a distal end, each position bar proximal end being attached to the junction of the first spacer bar intermediate portion and a spacer section, said position bar distal ends being attached to the junctions of the second spacer bar intermediate portion and spacer sections.

7. A spacing strap assembly as recited in claim 6, wherein:

each said spacer bar is adapted to being positioned about a decking board so that the spacer bar intermediate portion lies on the top surface of said board transversely to sa d board longitudinal axis, and the spacer bar spacer sections lie along the sides of the board.

8. A spacing strap assembly as recited in claim 7, further comprising:

a plurality of spacing cylinders, each said spacing cylinder adapted to be slid over a spacer section.

9. A spacing strap assembly as recited in claim 8, wherein:

each spacing strap layer is preferably made from a nylon webbing material.

10. A spacing strap assembly as recited in claim 9, wherein:

said spacing strap top layer is attached to the bottom layer by stitching.

* * * * *